OR 4,084,097

United

Czaplinski

[11] 4,084,097

[45] Apr. 11, 1978

[54] SHIELDED CONTAINER

[75] Inventors: Thomas V. Czaplinski, North Brunswick; Robert E. Heyer, Hopatcong, both of N.J.

[73] Assignee: E. R. Squibb & Sons, Inc., Princeton, N.J.

[21] Appl. No.: 750,927

[22] Filed: Dec. 15, 1976

[51] Int. Cl.[2] ..... G21F 5/00

[52] U.S. Cl. ..... 250/506; 250/364; 250/432 PD

[58] Field of Search ..... 250/506, 507, 328, 432 PD, 250/364

[56] References Cited

U.S. PATENT DOCUMENTS

| | | | |
|---|---|---|---|
| 3,852,599 | 12/1974 | Smith | 250/328 |
| 3,899,673 | 8/1975 | Packard | 250/328 |

*Primary Examiner*—Harold A. Dixon
*Attorney, Agent, or Firm*—Lawrence S. Levinson; Merle J. Smith; Stephen B. Davis

[57] ABSTRACT

A shielded container in which a vial containing a radioactive solution is housed. The container is constructed so that the activity of the radioactive solution can be measured in a radioisotope calibrator without exposing the technician to potentially harmful radioactivity.

29 Claims, 7 Drawing Figures

SHIELDED CONTAINER

BACKGROUND OF THE INVENTION

The use of radioisotopes such as technetium-99m in nuclear medicine, for diagnosis and treatment, is well known and its use is expanding rapidly. Generally, the isotope solution is eluted from a radioactive generator into a shielded vial just prior to its use. Such a generator is shown in U.S. Pat. No. 3,920,995 issued on Nov. 18, 1975 to Czaplinski et al.

Before such radioactive solution can be administered to a patient, the level of radioactivity must be determined. In the past, this has meant that the vial containing the radioactive solution must be removed from the shielded container by tongs and placed into a device known as a radioisotope calibrator. The radioisotope calibrator is a device having a well into which the vial is placed and the level of radioactivity is measured by comparison with standard sources used for calibrating the instrument. During this transferring operation the technician is exposed to radiation emitted from the unshielded vial.

SUMMARY OF THE INVENTION

This invention is directed to an improved shielding container which will permit the transfer of a vial containing a radioactive isotope solution to the measuring well of a radioisotope calibrator without exposing the technician to radiation emitted from the unshielded vial.

Figure 1:
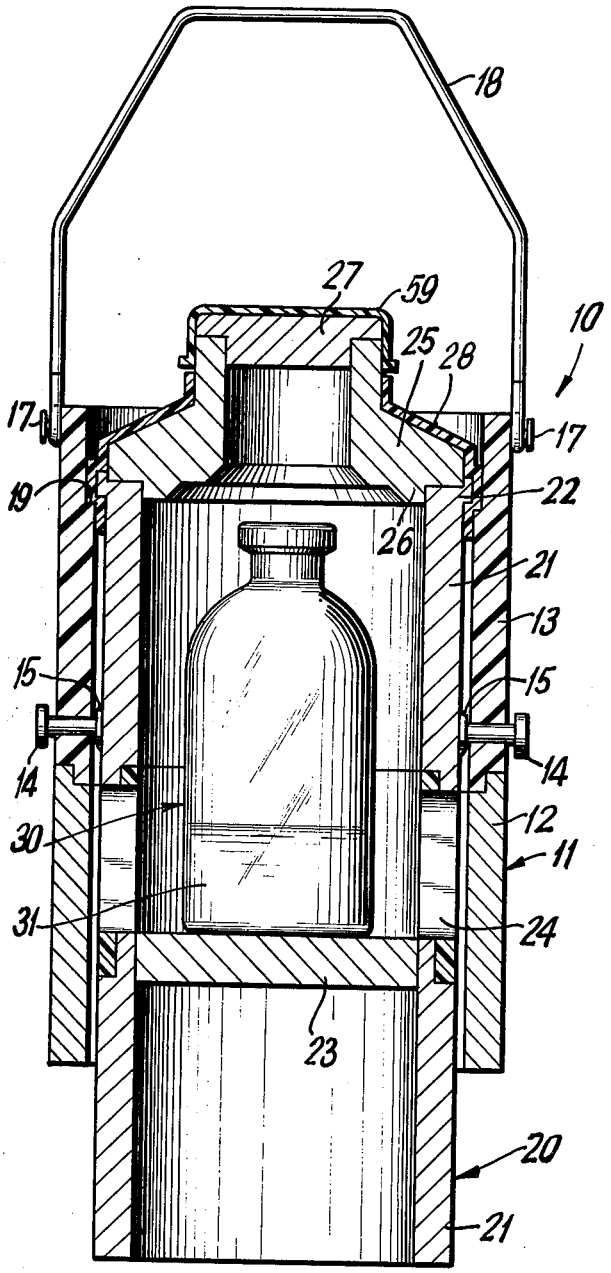
FIG. 1 is a front view of an embodiment of this invention taken along a central axis of the container in its shielded configuration.
Figure 2:
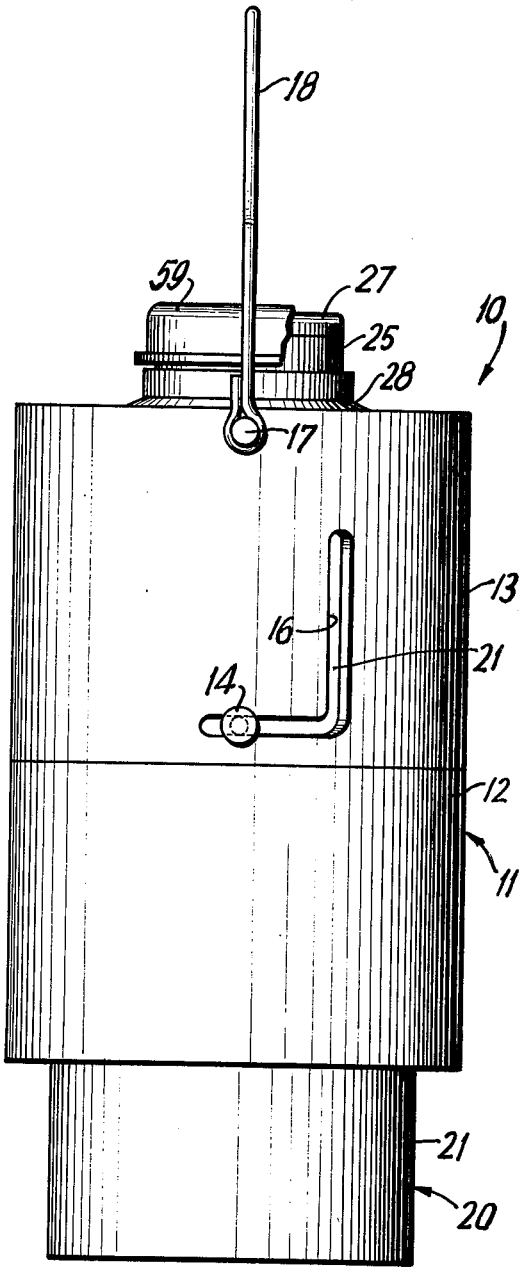
FIG. 2 is a side view of the container shown in FIG. 1.
Figure 3:
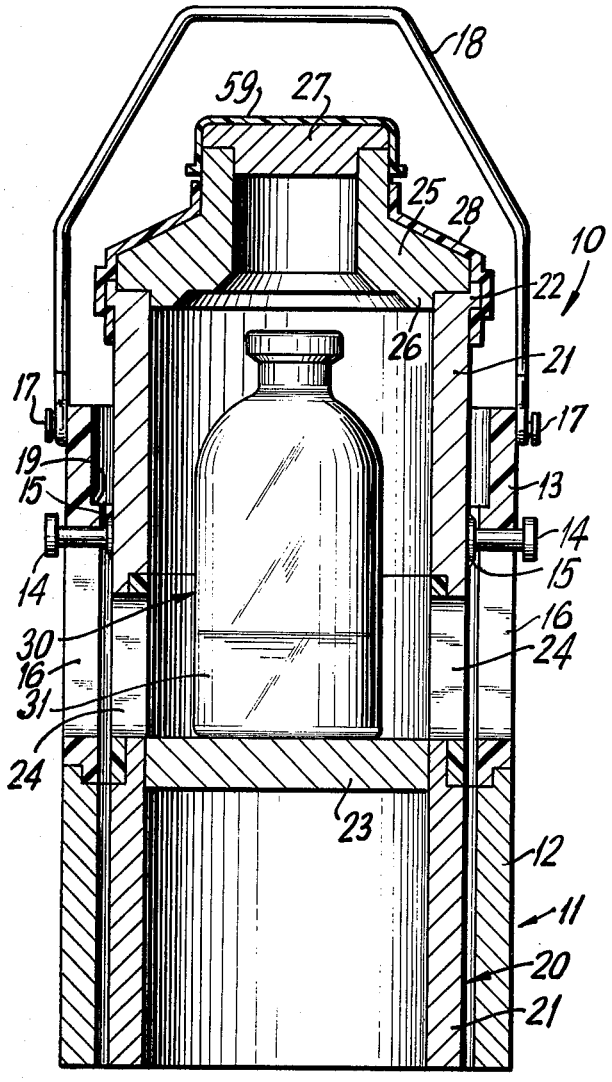
FIG. 3 is a front of the same container now in its unshielded configuration.
Figure 4:
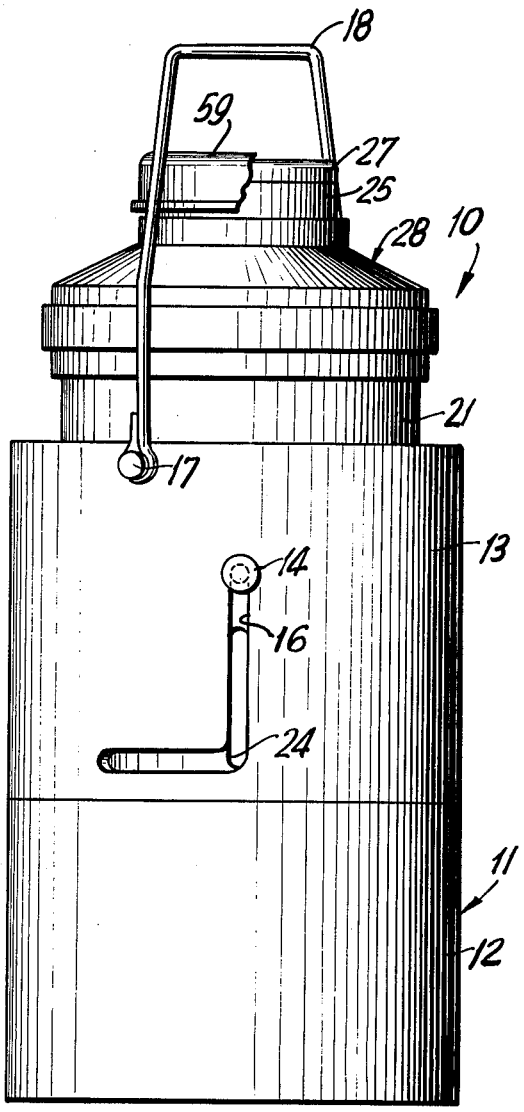
FIG. 4 is a side view of the container shown in FIG. 3.

The first embodiment of this invention as shown in FIGS. 1 to 4 comprises a generally cylindrical container 10 adapted to fit into the measuring well of a radioisotope calibrator. The container 10 comprises an outer rotatable hollow cylindrical sleeve 11 and an inner cylindrical body 20. The outer sleeve 11 comprises a lower wall 12 of a radioactive shielding material such as lead and an upper wall 13 of a substance permeable to radioactive emission, preferably a rigid polymeric material such as a polycarbonate. The wall sections 12 and 13 are formed with interlocking surfaces or can additionally be joined by use of adhesive as known in the art. The nonshielding cylindrical wall 13 of the outer sleeve has two L-shaped slots 16 as shown in FIGS. 2 and 4 cut into opposite sides and body pin 14 held in the slot by a locking nut 15 which is permanently anchored to sidewall 21. A container handle 18 is attached to the upper part of the wall 13 by hinge 17. The body pin, locking nut, hinge and handle can be formed from any suitable material including the same polymeric material as the wall 13 or in the case of the handle wire may be employed.

The inner open top cylindrical body 20 comprises a cylindrical side wall 21 having at its upper edge an outwardly extending flange 22 and bottom wall 23 of radioactive shielding material such as lead. As shown in FIGS. 1 and 3, openings 24 are cut into the side wall 21 just above the bottom wall. Preferably there are four such openings equally spaced around cylindrical wall 21 and the openings may optionally be sealed with the same radioactive permeable polymeric material as upper wall 13. Alternatively, instead of several openings 24 a continuous cylindrical wall 24 of radioactive permeable rigid polymeric material may be employed.

The container 10 is provided with a radioactive shielding closure. The structure of the closure may vary but the preferred closure shown in FIGS. 1 to 4 comprises a cover element 25 of radioactive shielding material such as lead, a plug 27 also of such shielding material, and a retaining ring 28 of semi-rigid polymeric material such as polypropylene which holds the cover element 25 in place. The cover element 25 rests on top of flange 22 and has a downwardly extending projection 26 which is dimensioned to fit snugly within the cylindrical opening of side wall 21. As shown in FIGS. 1 and 3, the cover element 25 leaves the outer most edge of flange 22 exposed and the cylindrical opening of cover element 25 is smaller than that of cylindrical side wall 21. Thus, when the cover element 25 is in place the vial 30 housed within the container 10 cannot be removed. The cover element 25 is attached to the side wall 21 by means of semi-rigid retaining ring 28 which is shaped to correspond to the outer surface of the cover element 25 and fit around the exposed surface of flange 22. By snapping the retaining ring into place as shown in FIGS. 1 and 3, the cover element 25 is locked to the inner cylindrical body 20. The plug 27 comprises two concentric discs the smaller of which is dimensioned to fit snugly within the cylindrical opening of cover element 25 and the larger of which rests on top of cover element 25. Housed within inner cylindrical body 20 is a vial 30 containing a radioisotope solution 31.

An outer cover 59 formed of semi-rigid polymeric material such as polypropylene fits over plug 27 and cover element 25 as shown in FIGS. 1 to 4.

Upper wall 13 of the outer sleeve 11 is formed of the same thickness as lower shielding wall 12 except in the area just above slot 16. At this point, the thickness decreases forming shoulder 19, as note FIGS. 1 and 3. Thus, when the outer sleeve 11 is in the shielding position as shown in FIGS. 1 and 2 the shoulder 19 will contact retaining ring 28 in the area of flange 22.

The embodiment of the invention shown in FIGS. 1 to 4 operates as follows. An evacuated vial 30 having a pierceable cap (not shown in the drawings) is placed within the inner container 20 so that it rests upon bottom wall 23. The cover element 25 is locked into position by means of retaining ring 28. The outer sleeve 11 is rotated so that body pins 14 are in the horizontal portion of the L-slot 16 as shown in FIG. 2. This positions the shoulder 19 against the retaining ring 28 and shielding sleeve wall 12 adjacent the nonshielding areas 24 of the inner cylindrical sidewall 21. The container is inverted and the vial is attached to the radioisotope generator such as that shown in U.S. Pat. No. 3,920,995 by piercing the cover of the vial. The vial is held within the container during this operation by cover element 25. After the desired amount of radioactive solution is in the vial, the generator is disengaged, the container is righted, and the shielding plug 27 is put in place. At this time, the technician is completely shielded from the radioactive material in the vial.

Just prior to the time when the radioactive solution is to be administered to the patient, the technician lifts the container 10 by means of the handle 18 and rotates the outer sleeve so that the body pins 14 are at the bottom of the vertical portion of the L-slots 16. The container 10 is then lowered into the measuring well of a radioisotope calibrator (not shown in the drawings). Upon reaching the bottom of the well the handle is released permitting the outer sleeve to move downward by gravity into the unshielding position shown in FIGS. 3 and 4. The activity of the solution 31 can then be measured through the permeable wall 13 and opening or permeable window 24. After the measurement is completed, the container is lifted out of the well by handle 18 causing the outer sleeve 11 to move upward back into shielding position. The outer sleeve 11 is then rotated so that the body pins 14 are back in the locking position shown in FIG. 2.

Figure 5:
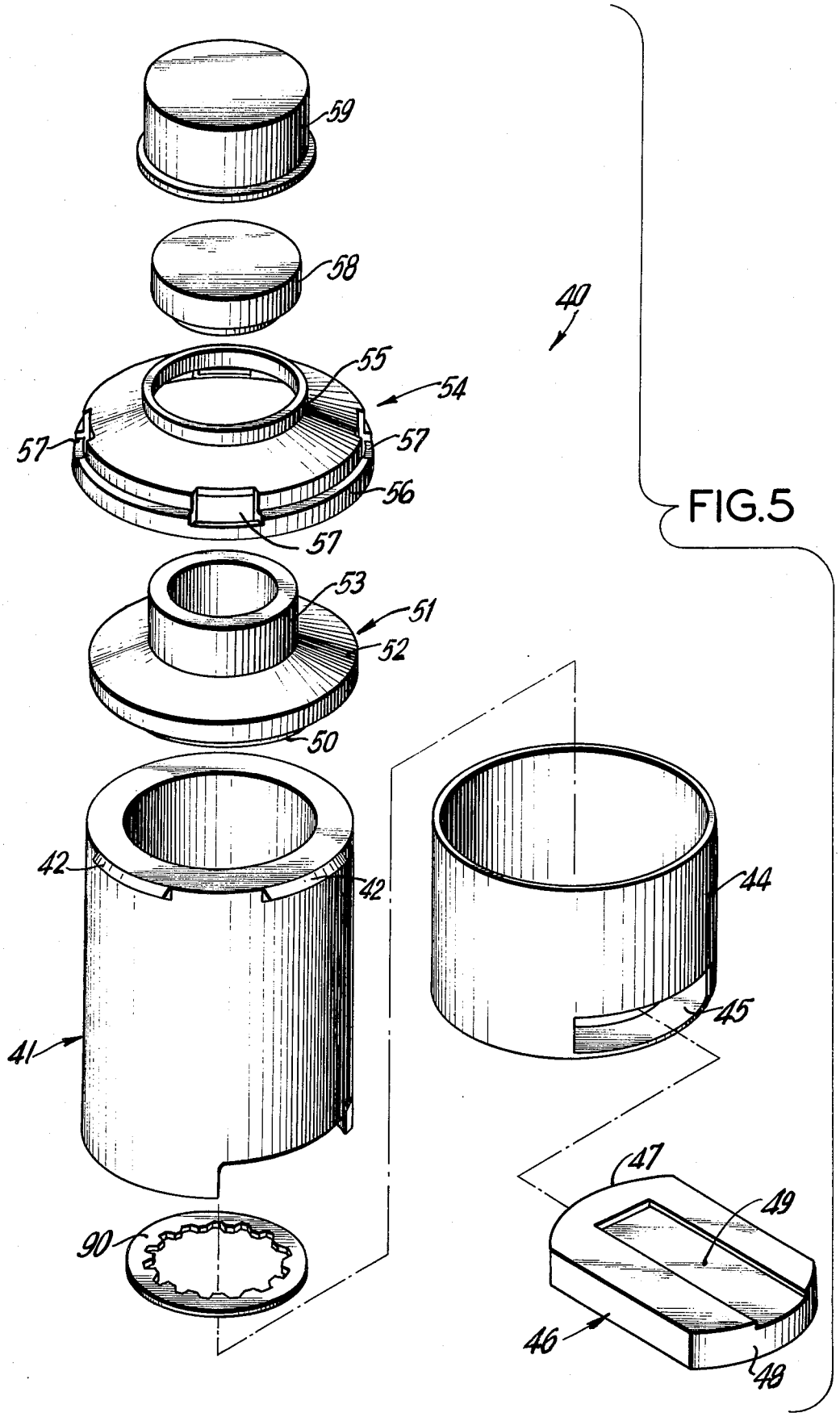
FIG. 5 is an exploded perspective of the constituent elements of another embodiment of the present invention.

A second embodiment of this invention is the container 40 whose elements are shown in an exploded view in FIG. 5. Container 40 comprises a hollow cylindrical body section 41 of a shielding material such as lead of approximately ⅜ inch thickness. The body 41 has several, preferably three, protruding edges 42 equally spaced around its top edge. A sector of the cylindrical sidewall 41 along its bottom edge is cut away to form an opening having two generally side walls joined by the curved inner cylindrical wall. The cylindrical body 41 fits within a housing 44 of nonshielding rigid or semi-rigid polymeric material. The housing 44 has a cylindrical side wall with an inner diameter slightly larger than the outer diameter of body 41 and a ring like bottom 45. The diameter of the opening in the bottom 45 is approximately the same as the inner diameter of the cylindrical body 41. The housing 44 has an opening cut through a section of its cylindrical sidewall corresponding in size to the opening in the cylindrical sidewall of body 41. The body section 41 is placed within the housing 44 so that the openings in the cylindrical side walls are aligned.

Bottom slide member 46 of shielding material such as lead is dimensioned to fit through the openings in the cylindrical side wall of housing 44 and body section 41. The rear wall 47 of the bottom slide member is curved so that it will make smooth contact with the curved inner cylindrical wall of body section 41 and the sidewalls are generally parallel to correspond to the sidewalls of the opening in body section 41. The slide member 46 is of sufficient length to contact the inner cylindrical wall and extend beyond the opening in the housing 44 a sufficient length to permit bottom slide member 46 to be gripped. The front wall 48 of the bottom slide member may be slightly curved.

Optionally the opening in bottom section 41 may be cut so as to leave a slight downwardly extending projection from the topwall of the opening and bottom slide member 46 may have a groove 49 cut into its top surface along a majority of its length. Thus, the bottom slide member can be pulled out a sufficient length to form an open passageway through the bottom of container but the downwardly extending projection will prevent the bottom slide member 46 from being completely removed from the container.

Another optional feature is gate member 90 of semi-rigid polymeric material in the shape of a ring having inwardly extending fingers. The gate member 90 is dimensioned to fit snugly within body section 41 just above the opening in the cylindrical sidewall. A groove may be cut in the inner cylindrical wall of body section 41 to anchor the gate member 90. The rigidity of gate member 90 is such that a vial containing radioactive solution will be supported by the fingers but by exerting a moderate amount of additionaly force the fingers will deform sufficiently to allow the vial to pass down beyond the gate and eventually to be pulled back above the gate.

Figure 7:
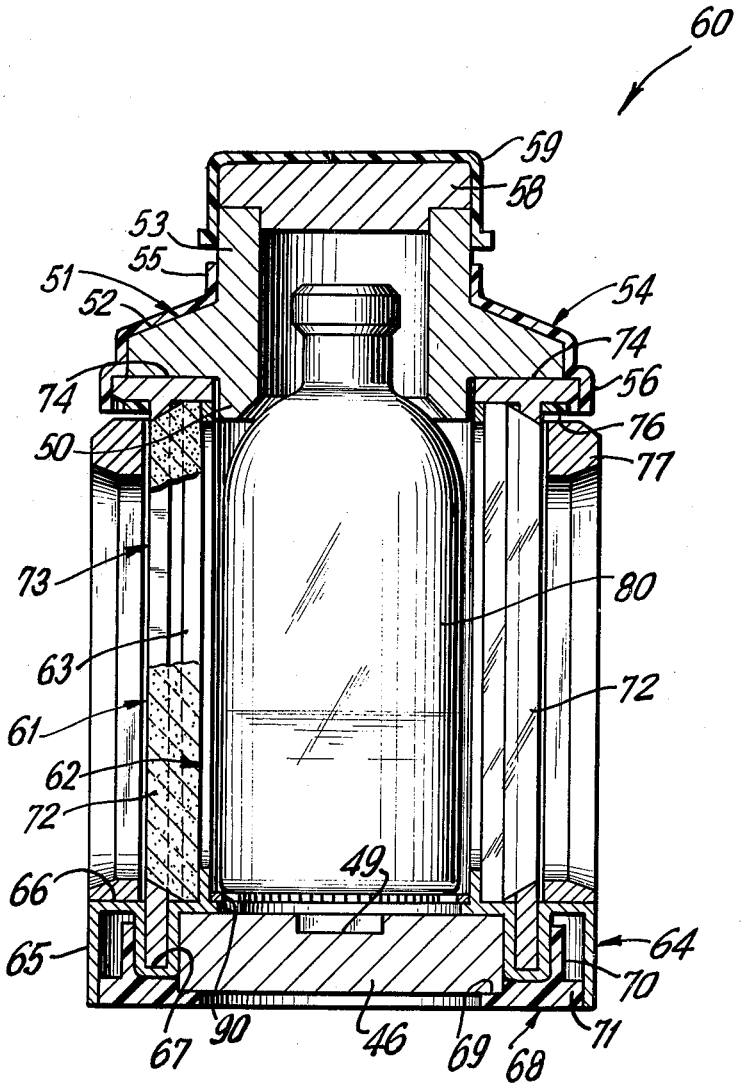
FIG. 7 is a front view of the container of FIG. 6 taken along a central axis.

As with container 10, container 40 is provided with a radioactive shielding closure whose structure may vary. The preferred closure is shown in FIGS. 5 and 7 consists of removable access cover 51 of shielding material such as lead. The access cover 51 is dimensioned to fit on top of the flat surface of body 41 and is a single piece having an inward and upwardly sloping outer wall 52, neck 53, and seating rim 50. The inner diameter of neck 53 and seating rim 50 is smaller than the inner diameter of body section 41 and is larger than the diameter of vial to be housed within the container 40. The access cover 51 is attached to the body 41 by means of retaining ring 54. Retaining ring 54 is of rigid or semi-rigid polymeric material and has the same general configuration as access cover 51 except that its neck 55 has a larger diameter than neck 53 and will fit around neck 53. Retaining ring 54 also has an outer skirt member 56 with several openings 57, preferably three, that are designed to correspond to the protruding edges 42 extending from the top of body section 41. Thus, the retaining ring 54 will fit down over access cover 51 and the protruding edges 42 will lock with openings 57. The remainder of the closure is a cap 58 of shielding material such as lead which fits over the neck 53 and an outer cover 59 of polymeric material which fits over cap 58 and neck 53.

Figure 6:
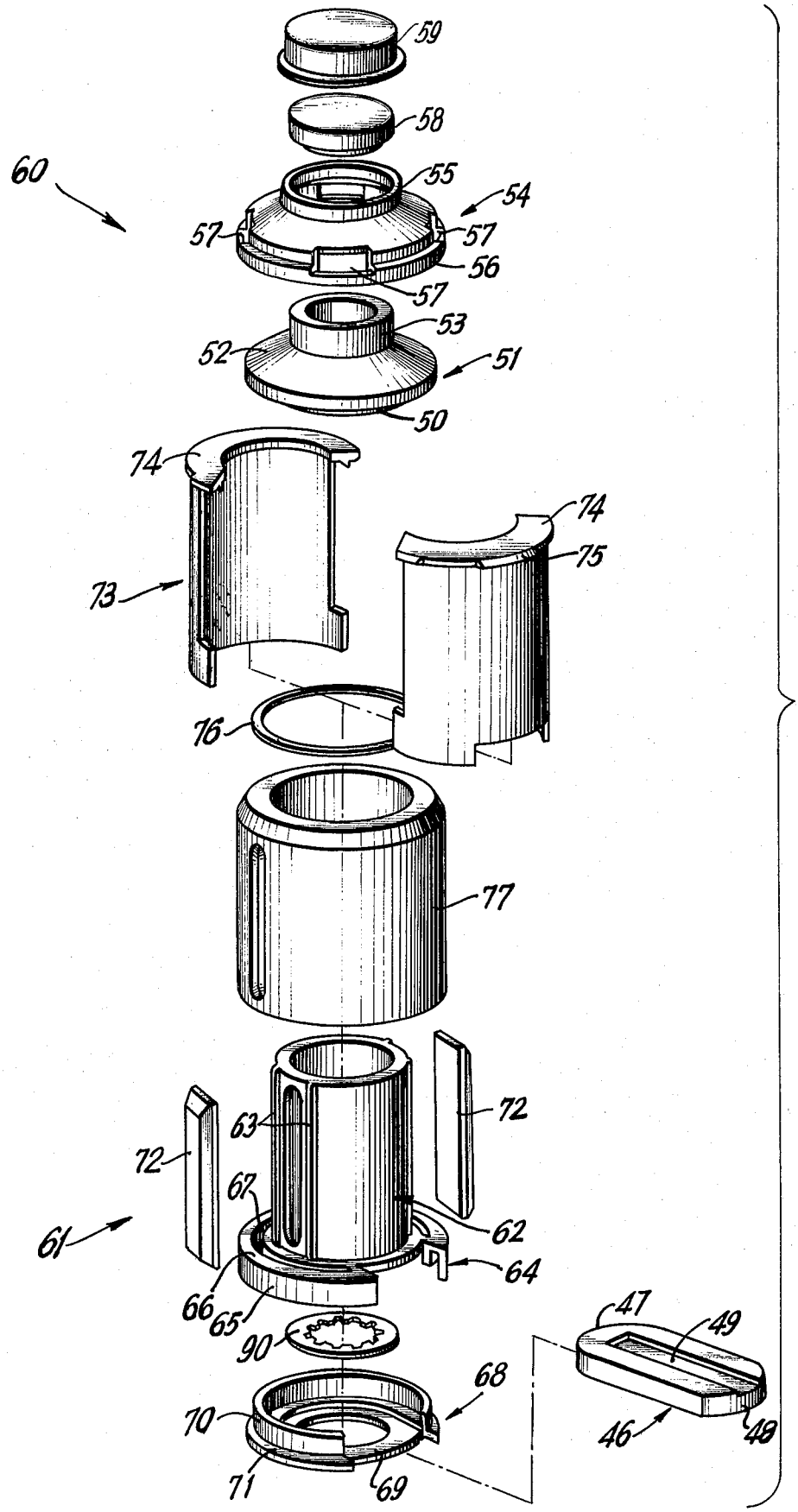
FIG. 6 is an exploded perspective of the constituent elements of a third embodiment of the present invention.

The closure shown for container 40 is also employed for container 60 shown in FIGS. 6 and 7. Thus, the top portion of FIG. 7 further illustrates the manner in which the elements of the closure of container 40 fit together.

The embodiment of the invention shown in FIG. 5 operates as follows. The cylindrical body section 41 having gate member 90 anchored in place (gate member is an optical element) is fitted into housing 44 so that the openings in the cylindrical sidewalls are aligned. Bottom member 46 is slid into place so that back wall 47 is contacting the inner cylindrical wall of body section 41 thus sealing the opening in the bottom of the container. An evacuated vial having a pierceable cap is inserted in place within the body 41 and rests on the protruding fingers of gate 90 or if gate 90 has been omitted the vial rests directly on bottom slide member 46. The removable access cover 51 is attached to body section 41 by means of retaining ring 54. The container 40 is inverted and the vial is connected to a radioisotope generator such as that shown in U.S. Pat. No. 3,920,995 by piercing the cover of the vial. After the desired amount of radioactive solution is in the vial, the generator is disengaged, the container is righted, and the shielding cap 58 and cover 59 are put in place.

Just prior to the time when the radioactive solution is to be administered to the patient, the technician lifts container 40 and places it in position over the measuring well of a radioisotope calibrator. The outer cover 59 and shielding cap 58 are removed and the vial is grasped by tongs. The bottom member 46 is slid out from the container and the vial is gently lowered through gate 90 and the opening in bottom 45 into the measuring well. After the measurement is completed, the vial is lifted by the tongs back into the container above the gate member 90 and the slide member 46 is slid back into place. The cap 58 and cover 59 are returned and the vial is again housed within a completely shielded container.

The third embodiment of this invention is the container shown in FIGS. 6 and 7. Container 60 is similar in operation to container 40 shown in FIG. 5 and in fact many of the elements are identical and have been so numbered. Container 60, as will be described below, has the added feature of permitting viewing of the contents of the vial housed within the container.

Container 60 as shown in FIGS. 6 and 7 includes a core 61 preferably formed of rigid polymeric material such as polypropylene, a bottom slide member 46 of shielding material such as lead, an inner stationary shield 73 of lead, an outer rotatable shield 77 of lead, and a shielding closure.

The core 61 comprises an upstanding hollow cylindrical body section 62 having two pairs of parallel outwardly extending grooves 63 on opposite sides of the cylindrical sidewall and openings cut into the cylindrical sidewall in the area between each set of grooves and a base 64 encircling approximately ¾ of the periphery of cylindrical sidewall 62. The base 64 has a sidewall 65 and a topwall 66 having a downwardly projecting groove 67. The opening in base 64 is sized so that the bottom slide member 46 will fit into place with its curved rear wall 47 contacting the curved interior wall of groove 67. As with container 40, the cylindrical sidewall in the area not encircled by the base 64 may have a downwardly extending projection and the bottom slide member 46 may have a groove 49 cut along a majority of its length so as to prevent the slide member 46 from being completely removed from the container. Additionally, gate member 90 can be located within hollow cylindrical body section 62.

Bars 72 of a transparent shielding material, i.e. lead glass, are provided with beveled edges dimensioned to fit within the grooves 63 and cover the openings in the cylindrical sidewall 62. The bars 72 when in place extend outwardly over the groove 67 in the top of the base 64.

The bottom slide member 46 is held in place by means of housing 68. Housing 68 is formed of polymeric material and has a ring shaped bottom 69 whose central opening is large enough to permit passage of the vial 80 housed within the container 60, an upstanding wall 70 and outwardly extending wall 71 which are dimensional to fit tightly within the space between base sidewall 65 and groove 67 so as to lock the housing 68 to the core 61. The bottom slide member 46 is thus supported by ring shaped bottom 69 as shown in FIG. 7.

The inner stationary shield 73 is formed of lead and comprises a hollow cylindrical sidewall having a flat ring shaped top wall 74 whose inner diameter is approximately equal to the outer diameter of hollow cylindrical body section 62. The top wall 74 has several, preferably three, protruding areas 75 spaced around its outer edge. The bottom portion of the stationary shield 73 fits within groove 67 and thus completely encircles the non-shielding cylindrical body section 62 except in the area of the leaded glass bars 72. As can be seen in FIGS. 6 and 7, the stationary shield 73 is preferably formed as two sections which when inserted in groove 67 fit around the outwardly extending bars 72. These two sections are locked together by means of locking ring 76 formed of polymeric material which is dimensioned to fit snugly around the sections and is slid into place just below top wall 74. Of course, if the inner stationary shield 73 is formed as a single unit then locking ring 76 is omitted.

The outer rotatable shield 77 is a hollow cylinder formed of lead having two openings cut in opposite sides of the cylindrical sidewall corresponding in size to the openings cut in the cylindrical sidewall of body section 62. The bottom of shield 77 rests upon base top wall 66 around the perimeter of groove 67.

The preferred shielding closure for container 60 is the same as that employed for container 40. Access cover 51 is dimensioned to fit on top of flat ring shaped top wall 74 and is a single piece having an inward and upwardly sloping outer wall 52, neck 53, and seating rim 50. The inner diameter of neck 53 and seating rim 50 is smaller than the inner diameter of body section 52 and is larger than the diameter of vial to be housed within the container 60. The access cover 51 is attached to the inner stationary shield 73 by means of retaining ring 54. Retaining ring 54 is of rigid or semi-rigid polymeric material and has the same general configuration as access cover 51 except that its neck 55 has a larger diameter than neck 53 and will fit around neck 53. Retaining ring 54 also has an outer skirt member 56 with several openings 57, preferably three, that are designed to correspond to the protruding edges 75 extending from the top wall 74 of shield 73. Thus, the retaining ring 54 will fit down over access cover 51 and the protruding edges 75 will lock with openings 57. The remainder of the closure is a cap 58 of shielding material such as lead which fits over the neck 53 and an outer cover 59 of polymeric material which fits over cap 58 and neck 53.

The embodiment of the invention shown in FIGS. 6 and 7 operates as follows. The two leaded glass bars 72 are inserted in place in grooves 63. The gate member 90 is anchored in place within cylindrical body section 62 (the gate member is an optional element). Housing 68 is locked into position beneath base 64 and bottom slide member 46 is slid into position so that rear wall 47 contacts the wall of groove 67. An evacuated transparent vial 80 having a pierceable cap is placed within cylindrical body section 62 and rests upon the protruding fingers of gate 90 or if gate 90 has been omitted the vial rests directly on bottom slide member 46. The two sections comprising inner stationary shield 73 are locked together by ring 76. Outer rotatable shield 77 is slid over shield 73 and both shields are lowered into place on base 64. The bottom portion of inner shield 73 will fit into groove 67 so that the cylindrical walls of shield 73 fit around the protruding leaded glass bars 72. The outer shield 77 will rest directly upon topwall 66. The removable access cover 51 is attached to inner stationary shield 73 by means of retaining ring 54. The container 60 is inverted and the vial 80 is connected to a radioisotope generator such as that shown in U.S. Pat. No. 3,920,995 by piercing the cap of vial 80. After the desired amount of radioactive solution is in the vial, the generator is disengaged, the container is righted, and the shielding cap 58 and cover 59 are put in place.

At this time the amount of radioactive material in the vial can be observed by rotating outer shield 77 so that its openings are aligned with the leaded glass bars 72. Thus, the technician is protected by the leaded glass bars 72 while making this observation. After the observation is completed the outer shield 77 can be rotated so that the leaded glass bars 72 are no longer exposed.

Just prior to the time when the radioactive solution is to be administered to the patient, the technician lifts container 60 and places it in position over the measuring well of a radioisotope calibrator. The outer cover 59 and shielding cap 58 are removed and the vial is grasped by tongs. The bottom member 46 is slid out from the container and the vial is gently lowered through gate 90 and the opening in bottom 69 into the measuring well. After the measurement is completed, the vial is lifted by the tongs back into the container above the gate member and the bottom 46 is slid back into place. The cap 58 and cover 59 are returned and the vial is again housed within a completely shielded container.

What is claimed is:

1. A shielded container adapted to fit within the measuring well of a radioisotope calibrator comprising an inner open topped cylindrical body having a cylindrical sidewall and a bottom wall both of radioactive shielding material with areas of the cylindrical sidewall just above the bottom wall being nonshielding, an outer rotatable hollow cylindrical sleeve having its lower wall of radioactive shielding material and its upper wall of nonshielding material, a vial containing a radioactive solution housed within the inner cylindrical body and resting on the bottom wall, a radioactive shielding closure for the open topped inner cylindrical body, and positioning means whereby the shielding portion of said outer sleeve can be locked into a position adjacent the nonshielding areas of said inner cylindrical sidewall and then when the container is located in the measuring well of a radioisotope calibrator said outer sleeve will be in a position such that said unshielded upper wall of said sleeve is adjacent the nonshielding areas of said inner cylindrical sidewall.

2. The container of claim 1 wherein said upper edge of the open topped inner cylindrical body has an outwardly extending flange and the shielding closure comprises a cover element of shielding material which rests on top of said flange and includes a cylindrical downwardly extending projection that contacts the interior wall of said inner cylindrical body and has a cylindrical opening smaller than the opening of said inner cylindrical body, a plug of shielding material which seals the opening of said cover element, and a retaining ring which anchors the cover element to said flange.

3. The container of claim 2 wherein said means positioning the outer sleeve relative to said inner cylindrical sidewall comprises L-shaped slots cut into two opposite sides of said nonshielding upper wall of said outer sleeve and a body pin located in each of said slots.

4. The container of claim 3 having a handle attached to said nonshielding upper wall of said outer sleeve.

5. The container of claim 4 wherein said shielding portions are formed of lead and the nonshielding upper wall of said outer sleeve is formed of rigid polymeric material.

6. The container of claim 5 wherein the nonshielded areas of said inner cylindrical sidewall are several equally spaced openings cut into the lead sidewall.

7. The container of claim 6 wherein said openings are sealed with the same nonshielding rigid polymeric material as the upper wall of said outer sleeve.

8. The container of claim 5 wherein the nonshielded areas of said inner cylindrical sidewall comprises a continuous cylindrical wall formed of the same nonshielding rigid polymeric material as the upper wall of said outer sleeve.

9. A shielding container adapted to fit over the top of the measuring well of a radioisotope calibrator comprising a hollow cylindrical wall formed of radioactive shielding material having an opening cut through a section of said cylindrical wall, a slideable container bottom member also formed of radioactive shielding material which is dimensioned to slide in and out of said cylindrical wall opening, a vial containing radioactive material located within said container, and a radioactive shielding closure for said container, wherein said vial is supported within said container while said slideable bottom member is pulled out through said cylindrical wall opening and said vial is afterward lowered down out of said container into the measuring well of said radioisotope calibrator.

10. The container of claim 9 wherein said opening is cut up from the bottom of said shielding cylindrical body section and said shielding cylindrical body section fits within a housing, said housing comprising a cylindrical sidewall having an opening corresponding in size to the opening cut in said shielding cylindrical body section whereby both openings can be aligned to permit passage of said slideable container bottom member and a ring shaped bottom which supports the weight of said slideable bottom member and has an inner diameter large enough to permit passage of said vial out of the container.

11. The container of claim 10 wherein said housing is formed of non-shielding rigid or semi-rigid polymeric material.

12. The container of claim 11 wherein said slideable bottom member has a curved rear wall which makes smooth contact with the inner cylindrical wall of the shielding cylindrical body section and is of sufficient length so that a portion of the bottom ember will always extend beyond said openings in the sidewalls of said cylindrical body section and said housing.

13. The container of claim 13 wherein said shielding closure includes a removable access cover formed of shielding material having an inner diameter less than the inner diameter of the shielding cylindrical body section but greater than the diameter of the vial, a retaining ring of rigid or semi-rigid polymeric material which fits over the access cover and anchors the access cover to the shielding cylindrical body section, and a cap of shielding material which seals the opening of the access cover.

14. The container of claim 13 wherein said access cover has an outer wall which is generally upwardly and inwardly sloping, a neck, and a seating rim dimensioned to seat the access cover on top of the shielding cylindrical body section, said shielding cylindrical body section has several protruding edges along its top edge, and said retaining ring is of the same general configuration as the access cover and includes a skirt portion which extends down beyond the access cover and has openings which mate with said protruding edges to anchor the access cover to the top of the shielding cylindrical body section.

15. The container of claim 14 wherein said vial is supported by means located above the slideable bottom member said means permitting the vial to pass down out of the container by the exertion of force when said slideable bottom member has been withdrawn a sufficient distance.

16. The container of claim 15 wherein there is a downwardly extending projection from the top of the opening cut in the sidewall of said shielding cylindrical body section and a groove cut in the top of the slideable bottom member along the majority of its length so that said projection will fit within said groove and prevent the slideable bottom member from being completely pulled away from said container.

17. The container of claim 14, wherein said vial rests directly upon said slideable bottom member and is supported by tongs passed down through the top opening of said container while said bottom member is pulled out through said cylindrical wall opening.

18. The container of claim 17 wherein there is a downwardly extending projection from the top of the opening cut in the sidewall of said shielding cylindrical body section and a groove cut in the top of the slideable bottom member along the majority of its length so that said projection will fit within said groove and prevent the slideable bottom member from being completely pulled away from said container.

19. A shielding container adapted to fit over the top of the measuring well of a radioisotope calibrator comprising a core of non-shielding material including an upstanding hollow cylindrical body section having at least one slot shaped opening in the sidewall and a base encircling the periphery of the cylindrical body section said base comprising a top wall having a downwardly extending groove and a sidewall, a bottom slide member of shielding material dimensioned to fit under said hollow cylindrical body section, a housing having a ring shaped bottom whose inner diameter is approximately equal to the inner diameter of said cylindrical body section said housing being attached to the bottom of said base and supporting the weight of said bottom slide member, an inner generally cylindrically shaped hollow stationary shield formed of radioactive shielding material whose bottom fits within said groove in said base topwall and completely encircles said cylindrical body section, said inner shield having at least one slot shaped opening corresponding in size to the opening in said cylindrical body section and a flat topwall, an outer rotatable generally cylindrically shaped hollow shield formed of radioactive shielding material which sits upon said base topwall encircling said stationary shield, said outer shield having at least one slot shaped opening corresponding in size to that in said inner shield, at least one bar of transparent radioactive shielding material attached over the opening in said cylindrical body section and protruding to fill the opening in said inner shield, a transparent vial containing radioactive material located within said cylindrical body section, and a radioactive shielding closure attached to the flat top wall of said inner stationary shield wherein the outer shield can be rotated so as to align its opening with the transparent shielding material and permit viewing of said vial and wherein said vial is supported within said cylindrical body section while said slideable bottom member is pulled out from beneath said cylindrical body section.

20. The container of claim 19 wherein said radioactive transparent shielding material is leaded glass.

21. The container of claim 20 wherein said housing has an upstanding wall and an outwardly projecting wall which contact said downwardly projecting groove and said base sidewall.

22. The container of claim 21 wherein said base and said upstanding wall and outwardly projecting wall of said housing are not continuous and when said housing is attached to said base an opening is formed and said bottom slide member is dimensioned to fit through this opening.

23. The container of claim 22 wherein said slideable bottom member has a curved rear wall which makes smooth contact with the downwardly projecting wall of said groove and is of sufficient length so that a portion of the bottom member will always extend beyond said openings in said base and said housing upstanding wall and outwardly projecting wall.

24. The container of claim 23 wherein said shielding closure includes a removable access cover formed of shielding material having an inner diameter less than the inner diameter of the upstanding cylindrical body section but greater than the diameter of the vial, a retaining ring of rigid or semi-rigid polymeric material which fits over the access cover and anchors the access cover to the inner shielding cylindrical body section, and a cap of shielding material which seals the opening of the access cover.

25. The container of claim 24 wherein said access cover has an outer wall which is generally upwardly and inwardly sloping, a neck, and a seating rim dimensioned to seat the access cover on top of said stationary inner shield, said inner shield has several protruding edges along its top edge, and said retaining ring is of the same general configuration as the access cover and includes a skirt portion which extends down beyond the access cover and has openings which mate with said protruding edges to anchor the access cover to the top of said inner shield.

26. The container of claim 25 wherein said vial is supported by means located above the slideable bottom member said means permitting the vial to pass down out of the container by the exertion of force when said slideable bottom member has been withdrawn a sufficient distance.

27. The container of claim 26 wherein there is a downwardly extending projection from bottom of said upstanding cylindrical body section and a groove cut in the top of the slideable bottom member along the majority of its length so that said projection will fit within said groove and prevent the slideable bottom member from being completely pulled away from said container.

28. The container of claim 25 wherein said vial rests directly upon the slideable body member and is supported by tongs passed down through the top opening of said container while said slideable bottom member is pulled out from beneath said cylindrical body section.

29. The container of claim 28 wherein there is a downwardly extending projection from bottom of said upstanding cylindrical body section and a groove cut in the top of the slideable bottom member along the majority of its length so that said projection will fit within said groove and prevent the slideable bottom member from being completely pulled away from said container.

* * * * *